US010925329B2

(12) United States Patent
Liao

(10) Patent No.: US 10,925,329 B2
(45) Date of Patent: Feb. 23, 2021

(54) NURSING COVER

(71) Applicant: Ennovate Products LLC, Irvine, CA (US)

(72) Inventor: Johnny Chi-Pao Liao, Irvine, CA (US)

(73) Assignee: ENNOVATE PRODUCTS LLC, Irvine, CA (US)

( * ) Notice: Subject to any disclaimer, the term of this patent is extended or adjusted under 35 U.S.C. 154(b) by 320 days.

(21) Appl. No.: 15/995,068

(22) Filed: May 31, 2018

(65) Prior Publication Data

US 2018/0343933 A1 Dec. 6, 2018

Related U.S. Application Data

(63) Continuation of application No. 62/512,911, filed on May 31, 2017.

(51) Int. Cl.
*A41D 1/21* (2018.01)
*A41D 1/215* (2018.01)

(52) U.S. Cl.
CPC ..... *A41D 1/215* (2018.01)

(58) Field of Classification Search
CPC ..... A41D 15/00; A41D 1/18; A41D 1/215; A41D 3/08; A41D 27/28; A41D 31/00
See application file for complete search history.

(56) References Cited

U.S. PATENT DOCUMENTS

| | | | | | |
|---|---|---|---|---|---|
| 1,297,742 | A * | 3/1919 | Shorrock | A41C 1/20 | 2/257 |
| 4,716,597 | A * | 1/1988 | Griggs | A41D 1/215 | 2/88 |
| 5,259,068 | A | 11/1993 | Carroll | | |
| 5,479,662 | A * | 1/1996 | Runco | A41D 1/215 | 2/104 |
| 5,544,364 | A | 8/1996 | Weber | | |
| 5,652,958 | A * | 8/1997 | Farrell-Mestas | A41D 1/215 | 2/48 |
| 5,893,171 | A | 4/1999 | Ries | | |
| 6,216,274 | B1 | 4/2001 | Harris | | |
| 7,112,117 | B2 * | 9/2006 | Horta | A41C 3/0007 | 2/255 |
| 7,406,718 | B2 * | 8/2008 | Ekelund | A41D 1/215 | 2/104 |
| 7,555,790 | B2 * | 7/2009 | Ostrander | A41D 1/205 | 2/104 |
| 8,091,145 | B2 * | 1/2012 | Ekelund | A41D 1/215 | 2/104 |
| 8,990,968 | B2 * | 3/2015 | Garegnani | A41D 1/215 | 2/104 |
| 10,264,832 | B2 * | 4/2019 | Gibbons | A41D 3/08 | |
| 2008/0034462 | A1 * | 2/2008 | Ekelund | A41D 1/215 | 2/104 |
| 2008/0034463 | A1 | 2/2008 | Ekelund et al. | | |

(Continued)

*Primary Examiner* — Clinton T Ostrup
*Assistant Examiner* — Andrew Wayne Sutton
(74) *Attorney, Agent, or Firm* — Loza & Loza, LLP; Michael F. Fedrick

(57) ABSTRACT

The present nursing cover comprises a panel having a semirigid support retained in a sleeve in the upper side of the panel which forms an opening that allows a caregiver easier access to a nursing infant when the nursing cover is in use. A pouch for storing the nursing cover when not in use is attached to the upper side of the panel.

20 Claims, 13 Drawing Sheets

(56) References Cited

U.S. PATENT DOCUMENTS

| | | | | |
|---|---|---|---|---|
| 2011/0289650 | A1* | 12/2011 | Arrona | A41B 3/06 2/129 |
| 2011/0296581 | A1* | 12/2011 | Armstrong | A41D 1/215 2/104 |
| 2012/0151657 | A1* | 6/2012 | Gibbons | A41F 1/008 2/104 |
| 2014/0223640 | A1* | 8/2014 | English | A41B 3/06 2/256 |

* cited by examiner

NURSING COVER

CROSS-REFERENCE TO RELATED APPLICATIONS

This application claims the benefit of priority under 35 U.S.C. § 120 from U.S. Patent Application No. 62/512,911, filed May 31, 2017 and entitled NURSING COVER. The disclosure of the foregoing application is incorporated herein by reference in its entirety.

BACKGROUND

A nursing mother may find herself in a variety of locations when a child is in need of breastfeeding. In more public locations, a blanket or other cover may be used to provide privacy to the mother at this time. Covers that are specially designed for nursing mothers are generally secured around a mother's neck or in another manner in order to ensure such privacy.

Prior nursing covers have included a flexible neckline which is curved in order to allow a mother to see her baby during breastfeeding. However, this feature prevents a mother from being able to fully cover herself because of the flexibly curved neckline. There remains a need, therefore, for improved nursing covers.

SUMMARY

The present nursing cover comprises a panel having a semirigid support retained in a sleeve in the upper side of the panel which reversibly forms an opening that allows a caregiver easier access to a nursing infant when the nursing cover is in use. The panel has a front side, a back side, an upper side, and a lower side, and can be in the shape of a rectangle or other quadrilateral having a right side and a left side. The sleeve is attached to or otherwise provided in the panel adjacent to and/or below the upper side of the panel, preferably a central portion of the upper side of the panel. The sleeve has an upper side, a lower side, a right side having a right side opening, a left side having a left side opening, and a medial portion between the right side and the left side. The sleeve includes a hollow interior between the right side opening and the left side opening, in the manner of a channel between the right and left sides of the sleeve.

The sleeve is configured to retain a semirigid support placed therein. The semirigid support has a proximal end, a distal end, and a longitudinal extent between the proximal end and distal end, and includes a proximal fastener portion and a distal fastener portion. The proximal fastener portion is configured to be reversibly secured to a right side fixation point attached to the panel adjacent to the right side opening of the sleeve, and the distal fastener portion is configured to be reversibly secured to the left side fixation point adjacent to the left side opening of the sleeve. The distance between the right side fixation point and the left side fixation point is less than the distance between the proximal fastener portion and the distal fastener portion of the semirigid support. In this way, when the semirigid support is placed through the sleeve, the proximal fastener portion is attached to the right side fixation point, and the distal fastener portion is attached to the left side fixation point, then the upper side of the panel will extend outwardly in a collar portion formed by the sleeve and the semirigid support due to the bowing or other bending of the semirigid support. This forms an opening when the nursing cover is worn by a caregiver.

The semirigid support can further comprises an inner proximal fastener portion located distally with respect to the proximal fastener portion and an inner distal fastener portion located proximally with respect to the distal fastener portion. The distance between the inner proximal fastener portion and the inner distal fastener portion is less than the distance between the proximal fastener portion and the distal fastener portion, so that when the inner proximal fastener portion is attached to the right side fixation point and the inner distal fastener portion is attached to the left side fixation point, the upper side of the panel extends further outwardly than when the proximal fastener portion is attached to the right side fixation point and the distal fastener portion is attached to the left side fixation point. In some embodiments, the nursing cover can further include an outer right side fixation point and an outer left side fixation point, with the outer right side fixation point being attached to the panel further from the right side opening of the sleeve than the inner right side fixation point and the outer left side fixation point being attached further from the left side opening of the sleeve than the inner left side fixation point. In this embodiment, the semirigid support can also further include an inner proximal fastener portion located distally with respect to the proximal fastener portion and an inner distal fastener portion located proximally with respect to the distal fastener portion, with the inner proximal fastener portion being reversibly securable to the inner right side fixation point and the inner distal fastener portion being reversibly securable to the inner left side fixation point.

The present nursing cover further comprises a neck strap for retaining the panel on a caregiver during use. The neck strap has a proximal end and a distal end, with at least the proximal end being attached or reversibly securable to the upper side of the panel. Preferably, the neck strap comprises a first portion and a second portion, with a proximal end of the first portion of the neck strap being attached to the upper side of the panel to the right of the right side of the sleeve, and a proximal end of the second portion of the neck strap being attached to the upper side of the panel to the left of the left side of the sleeve. In this embodiment, a fastener can be attached to the distal end of the first portion or the second portion of the neck strap. The fastener can be a buckle attached to the second portion of the neck strap, in which case the distal end of the first portion of the neck strap can include holes for retaining the buckle. Alternatively, the fastener can be a release buckle, with mating portions of the release buckle being attached to the distal ends of the first portion and the second portion of the neck strap, respectively.

The present nursing cover can further include an attached storage pouch. The storage pouch has an open upper end and closed lower end, and a portion of the upper side of the pouch is attached to the upper side of the panel. Preferably, the pouch is attached to the panel adjacent to the sleeve. The storage pouch can further include a pull tab extending from the lower side of the storage pouch.

FIGURES

Figure 1:
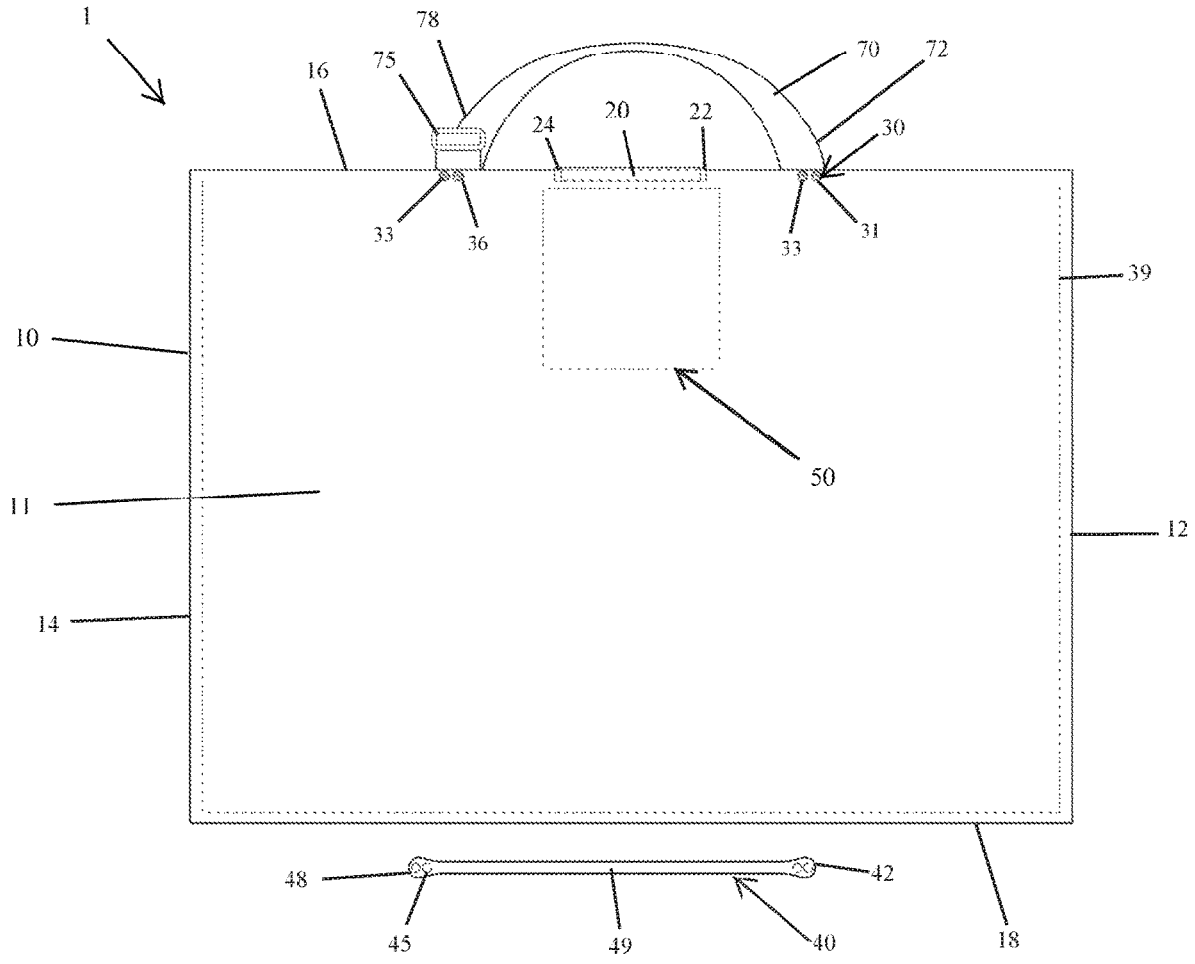
FIG. 1 is a front elevation view of the present nursing cover with the semirigid support removed.

The reference numbers in the figures refer to the following components:

| Component | Subcomponent | Reference Number |
|---|---|---|
| nursing cover | | 1 |
| | opening | 5 |
| panel | | 10 |
| | front side | 11 |
| | back side | 13 |
| | upper side | 16 |
| | lower side | 18 |
| | right side | 12 |
| | left side | 14 |
| sleeve | | 20 |
| | front side | 21 |
| | back side | 23 |
| | upper side | 26 |
| | lower side | 28 |
| | right side | 22 |
| | left side | 24 |
| | interior | 25 |
| | right side opening | 27 |
| | left side opening | 29 |
| fixation points | | 30 |
| | right side | 31 |
| | left side | 33 |
| | inner right side | 34 |
| | inner left side | 36 |
| collar | | 35 |
| stitching | | 39 |
| semirigid support or "stiffener" | | 40 |
| | proximal end | 42 |
| | distal end | 48 |
| | medial portion | 49 |
| | fastener portion | 45 |
| | proximal fastener portion | 41 |
| | distal fastener portion | 43 |
| | inner proximal fastener portion | 44 |
| | inner distal fastener portion | 46 |
| storage pouch | | 50 |
| | front panel | 51 |
| | back panel | 53 |
| | upper side | 56 |
| | lower side | 58 |

-continued

| Component | Subcomponent | Reference Number |
|---|---|---|
| | right side | 52 |
| | left side | 54 |
| | pull tab | 55 |
| | front panel inner face | 57 |
| | back panel inner face | 59 |
| | front panel outer face | 67 |
| | back panel outer face | (not shown) |
| | opening | 60 |
| neck strap | | 70 |
| | proximal end | 72 |
| | distal end | 78 |
| | first portion | 71 |
| | second portion | 73 |
| | fastener | 75 |

DESCRIPTION

Definitions

As used herein, the following terms and variations thereof have the meanings given below, unless a different meaning is clearly intended by the context in which such term is used.

"Arcuate" refers to a surface or shape which is curved, i.e. in the manner of a bow.

"Caregiver" and "user" generally refer to a user of the present nursing cover, e.g. a nursing mother of an infant.

"Elongated" refers to a configuration or shape having a length which is longer than its width.

"Fastener" refers to a mechanism for attaching one item or component of the present invention to another.

"Outer" refers to a surface or direction which faces or extends away from the present nursing cover or a component thereof, and may refer to a surface or direction which faces or extends away from the body of a user of the present nursing cover (i.e., the caregiver) when the nursing cover is in use. "Inner" may refer to the opposite direction or surface of the present nursing cover. With respect to the fastener portions and fixation points described herein, the term "inner" generally refers to a position which is medial with respect to another fastener portion or fixation point, i.e. further from a lateral side or portion of the present nursing cover.

"Panel" refers to a section or piece of flexible material, such as fabric, extending over or covering a predetermined area. Panels are generally relatively thin as compared to the extent of their length and width.

"Semirigid" refers to a component or material which is stiff and solid, but not inflexible, i.e. it has sufficient elasticity to allow the component to be bent without breaking or shattering, and has sufficient rigidity to resist being bent and to maintain its shape under the stress of being bent in the context of the present nursing cover. Such bending and stress are to be understood as being those which a human can produce without mechanical assistance. A number of polymer materials have appropriate properties for use as semirigid materials in the present invention.

"Sleeve" refers to an open-ended flat or tubular structure and includes a channel between the open ends, and which fits over or encloses a rod or other support.

"Strap" refers to a length of flexible material used to secure one portion of the nursing cover to another portion. Preferably, straps are relatively flat and have a length greater than their width, in the manner of a belt.

"Upper" refers to a position or direction in or toward an upper portion of the body of a user of the present nursing cover (i.e., the caregiver) when the nursing cover is in use. "Lower" refers to an opposing position or direction, e.g. toward a lower portion of a user's body.

The terms "upper," "lower," "top", "bottom, "outer," "inner," "right," "left," and similar terms will be used to designate areas and positions of portions of the present article, but it is to be understood that these terms are relative and are not absolute terms. "Right" and "left" will thus be used to designate opposing lateral sides of components of the present article of manufacture. "Upper" and "lower" will likewise be used to designate opposing faces or sides of components of the present article, and will be understood to be relative terms.

The term "comprise" and variations of the term, such as "comprising" and "comprises," are not intended to exclude other additives, components, integers or steps. The terms "a," "an," and "the" and similar referents used herein are to be construed to cover both the singular and the plural unless their usage in context indicates otherwise. Ranges which are described as being "between" two values include the indicated values.

Nursing Cover

The present invention relates to a nursing cover 1 which generally comprises a panel 10 for covering the torso of a nursing mother, a neck strap 70, and a semirigid support or "stiffener" 40. The panel 10 is an opaque sheet having a front side 11 facing outwardly when worn by a caregiver and a back side 13 facing inwardly toward the user when in use, as well as having an upper side 16, a lower side 18, and a sleeve portion 20. In the illustrated embodiments, the panel 10 is generally rectangular in shape, i.e. is a quadrilateral, and has a right side 12 and a left side 14, though embodiments with rounded configurations or different numbers of sides are possible. The panel 10 should be generally wide and long enough to cover a user's chest in order to provide a desired amount of privacy for nursing, and can preferably be wide enough to extend across a caregiver's shoulders and be at least as long as a user's waist. The panel 10 can be made from a variety of flexible, opaque materials, preferably from fabric. As shown in the illustrated embodiments, panels can be stitched around their edges with stitching 39 to form a hem, or can be sewn onto another piece of material to form a nursing cover 1 with a thicker panel and/or having a panel with a different color, print, or material on the front side 11 than on the back side 13.

During use, the nursing cover 1 can be supported by a neck strap 70, both ends of which are preferably attached to the upper side 16 of the panel 10. The neck strap 70 comprises at least a proximal end 72 attached to the upper side 16 of the panel and a distal end 78. The distal end can be fixedly attached to the upper side 16 of the panel 10, but preferably is reversibly secured or attached to the panel. As discussed further below, the proximal end 72 and distal end 78 are preferably secured to the upper side 16 of the panel on either side of the sleeve 20, i.e., such that one end of the strap 70 is attached laterally to the right of the sleeve along the upper side 16 of the panel and the other end of the strap 70 is attached laterally to the left of the sleeve along the upper side 16 of the panel 70. In one embodiment, the strap 70 can comprise a first portion 71 attached at a proximal end to the upper side 16 of the panel 10 and having a free distal end, and a second portion 73 also attached at a proximal end to the upper side 16 of the panel 10 and having a free distal end, and the distal ends of the first and second portions can be connected or attached to form the strap 70. In this way, the length of the strap 70 can more easily be adjusted.

The distal ends of the first and second portions 71, 73 can be connected for example by a fastener 75. The fastener 75 can be, for example, a belt buckle, which is conventionally formed with a frame, a bar and a prong, and which can be fastened to the second portion 73 of the neck strap 70 by inserting the prong through holes formed in the second portion 73 of the neck strap 70. Other buckles and fasteners known to the art, such as hook and loop closures (i.e., VELCRO® closures), can also be used. For example, a release buckle comprising a male buckle member (the hook end) and a female buckle member (the catch end) can be used. The male buckle member of a release buckle can consist of a center guide extending from the front side with two spring arms between the center guide. The two spring arms typically each have a retaining block or hook at the front end, and the female buckle member has a front open side which retains and secures the two spring arms of the male buckle member.

Collar

At the upper edge of the panel 10 is a collar 35 adjacent to a user's neck when worn. As used herein, "collar" refers to an upper portion of the nursing cover 1 including a sleeve 20, fixation points 30, and preferably also including a semirigid support or "stiffener" 40, which can be adjusted and/or removed completely if desired. Preferably, the collar 35, including the sleeve 20, is positioned between the attachments points for the two ends of the strap 70 to the upper side 16 of the panel 10, i.e. such that the proximal end 72 and distal end 78 of the strap 70 are positioned laterally with respect to the proximal and distal ends of the sleeve 20.

The sleeve 20 comprises a front side 21, a back side 23, an upper side 26, a lower side 28, a right side 22, a left side 24, a right side opening 27, and left side opening 29. Between the right side opening 27 and left side opening 29, the sleeve 20 has a hollow interior 25 which forms a channel between right side 22 and left side 24 of the sleeve 20. The sleeve 20 is attached to the upper portion of the panel 10, preferably adjacent to or slightly below the upper side 16 of the panel 10 and in a central portion of the upper side 16 of the panel. The sleeve can be formed integrally with the panel 10, or can be formed for example from a piece of flexible material attached to the panel 10, such as by stitching or otherwise attaching the longitudinal upper side 26 and/or lower side 28 to the panel 10. The sleeve 20 is preferably attached to the front side 11 of the panel, but can alternatively be on the back side 13.

Figure 2:
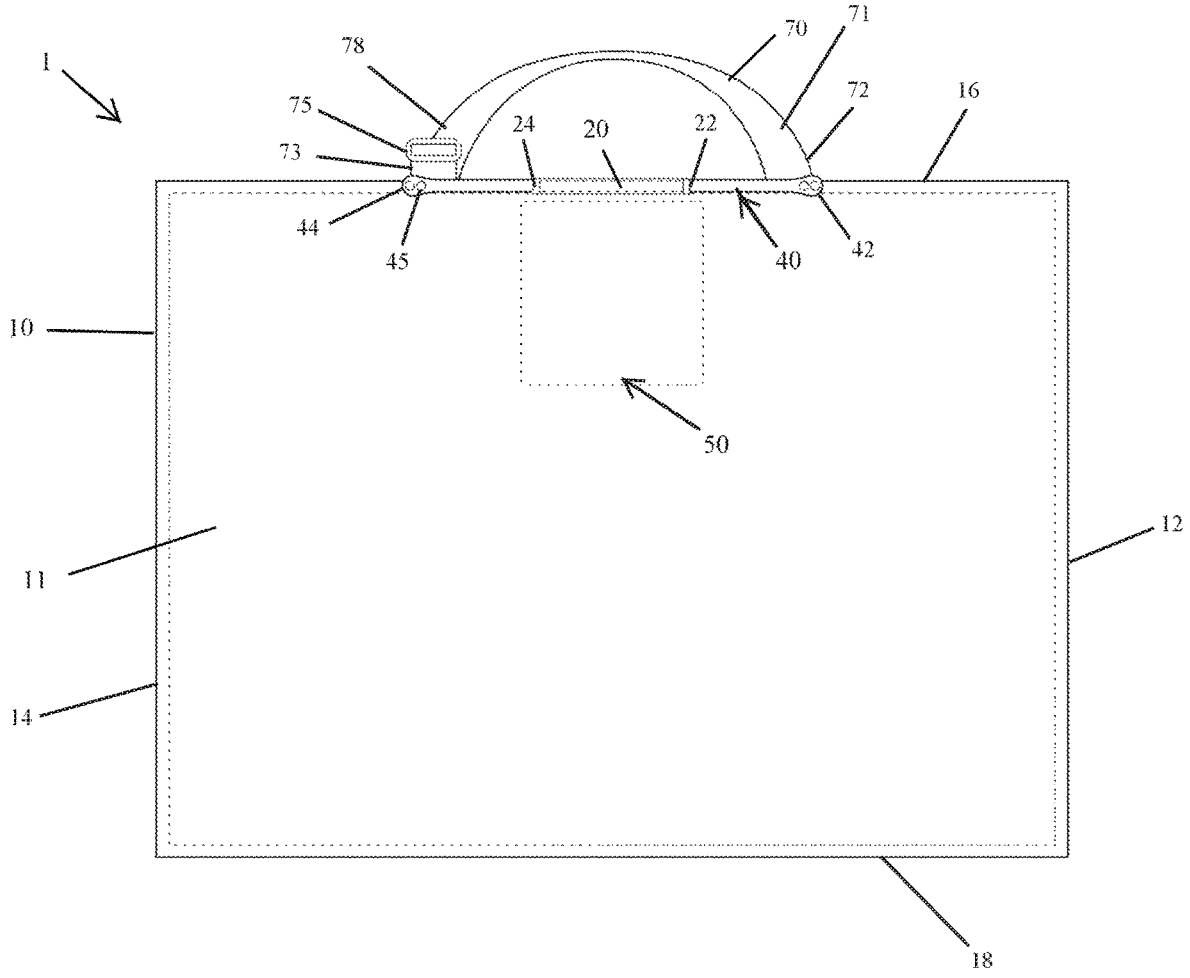
FIG. 2 is a front elevation view of the present nursing cover with the semirigid support installed but not attached to fixation points.
Figure 3:
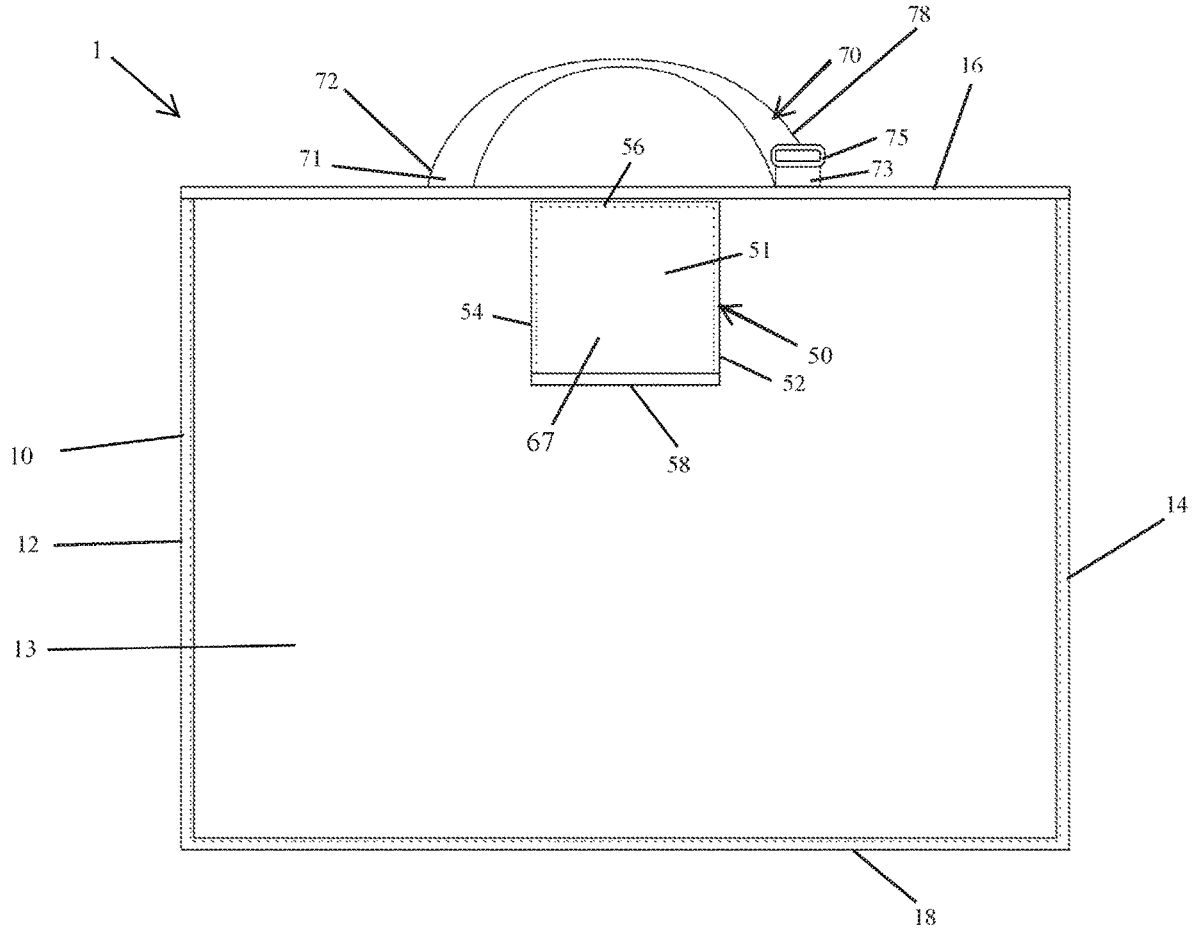
FIG. 3 is a rear elevation view of the present nursing cover.
Figure 4:
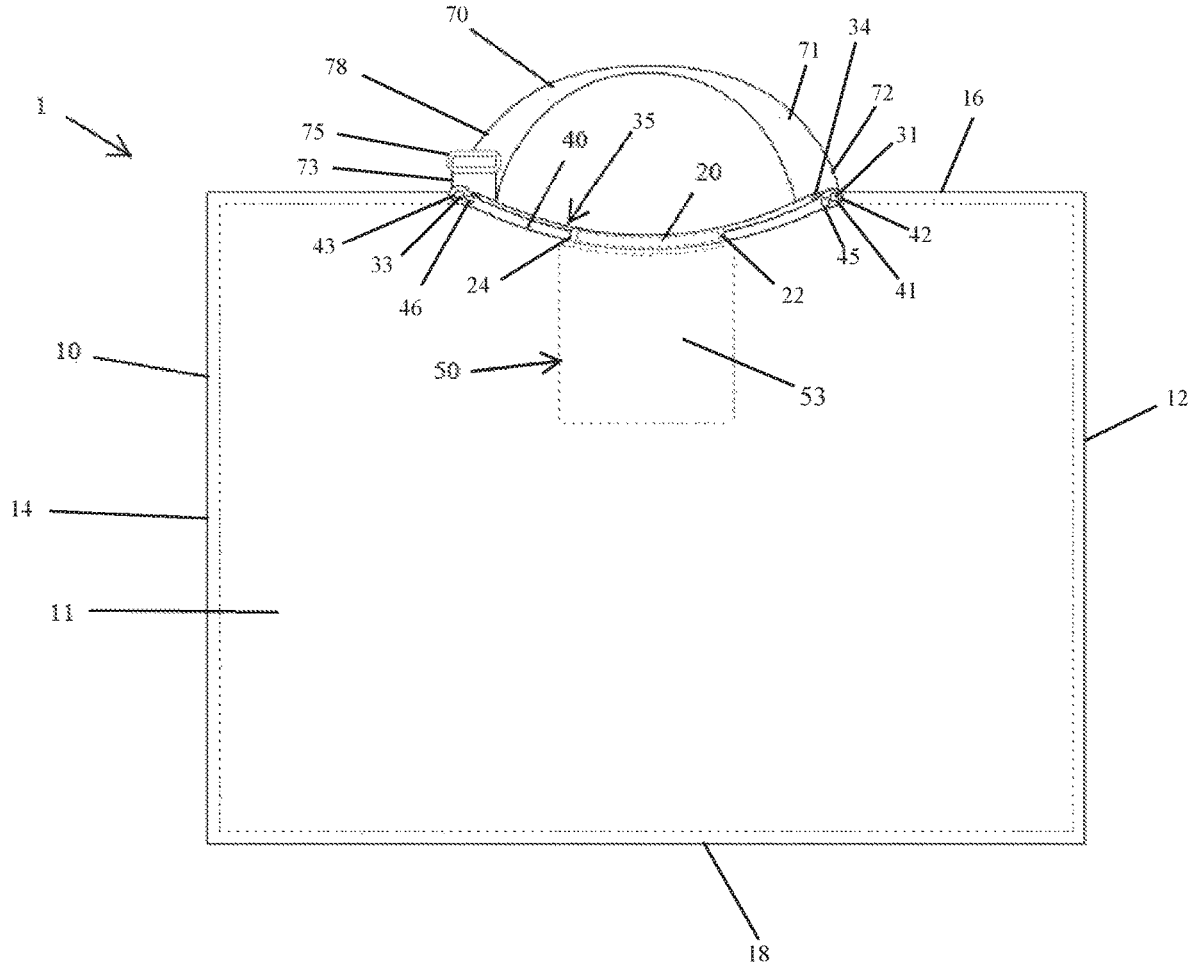
FIG. 4 is a front elevation view of the present nursing cover with the semirigid support installed and attached to the fixation points so as to create a curve.
Figure 5:
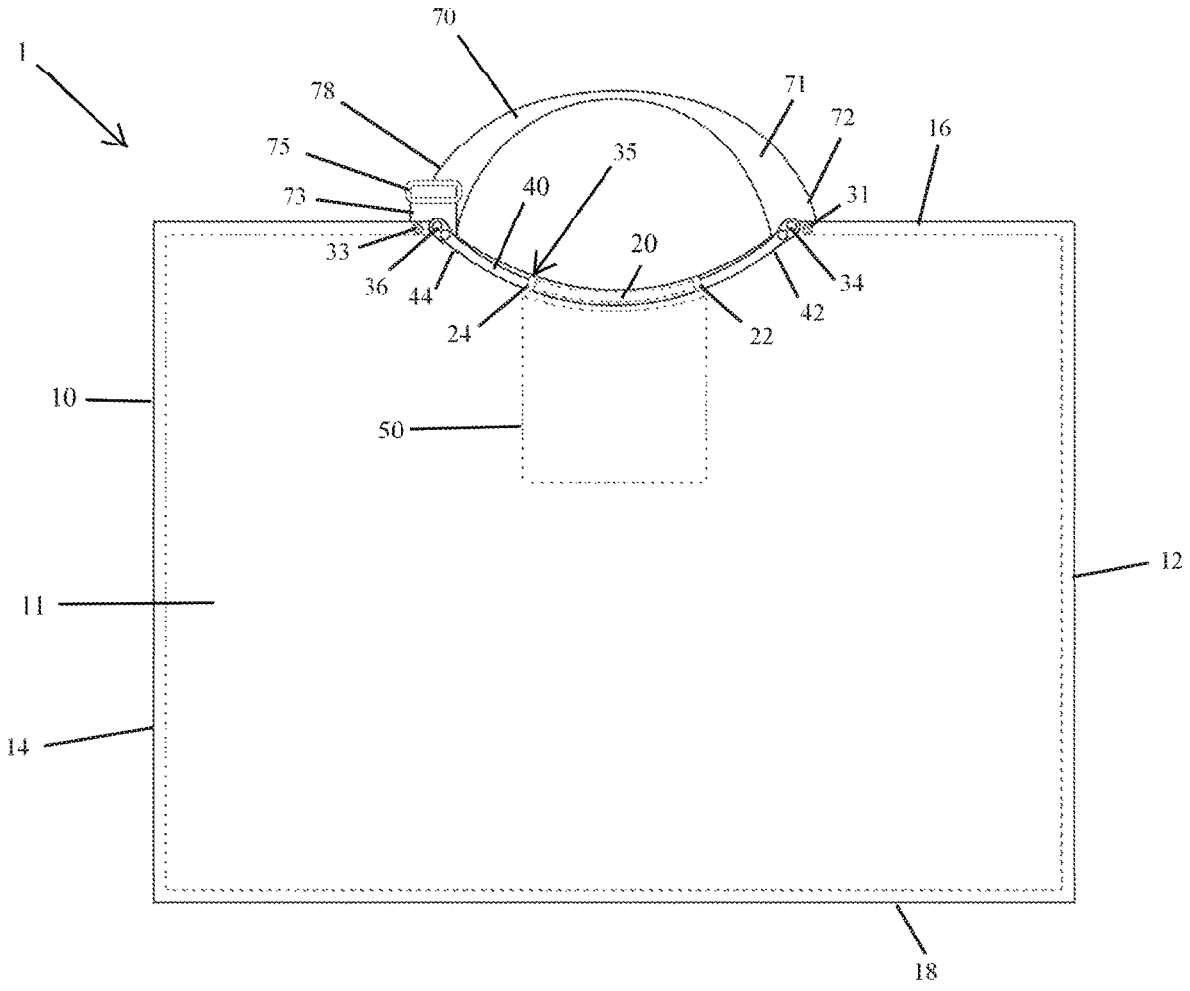
FIG. 5 is a front elevation view of the present nursing cover with the semirigid support installed and attached to the fixation points so as to create a greater curve than that shown in FIG. 4.
Figure 6A:
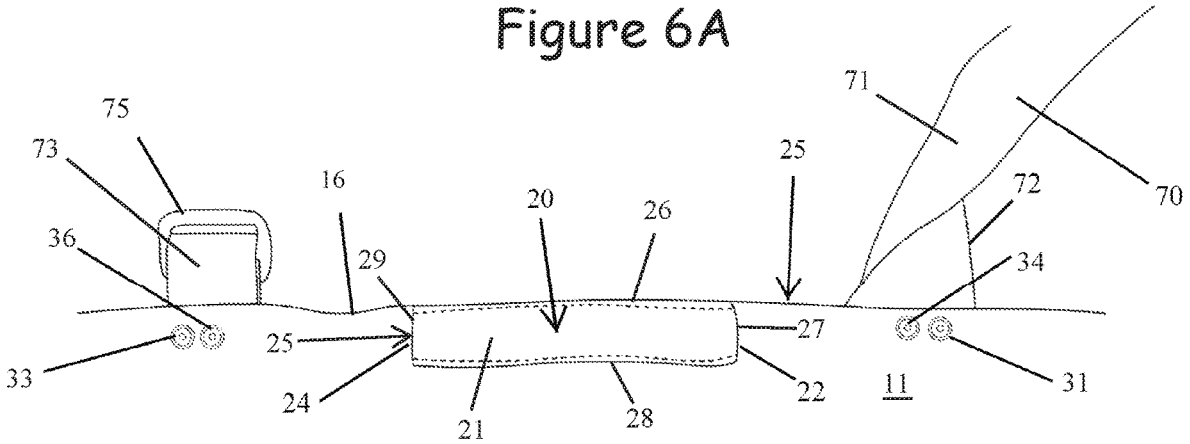
FIG. 6A is a front elevation view of the portion of the present nursing cover used to retain semirigid supports.
Figure 6B:
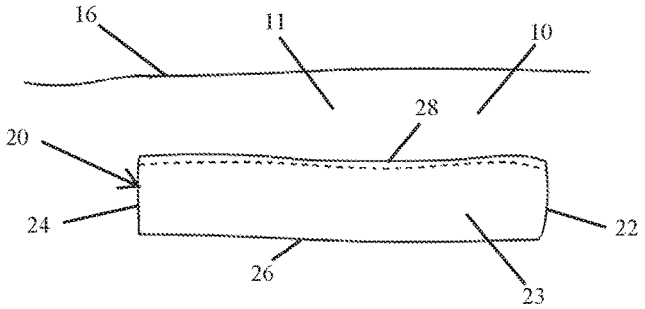
FIG. 6B is a front elevation view of the sleeve portion of the present nursing cover, with only the lower end attached to the nursing cover.
Figure 6C:
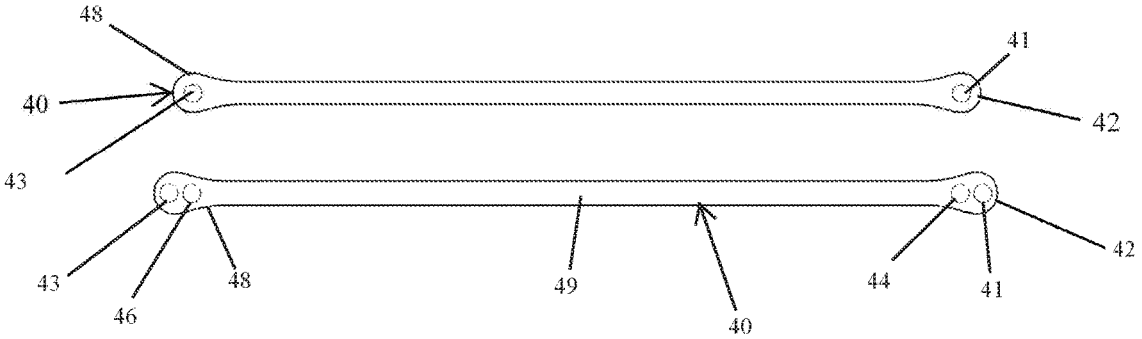
FIG. 6C is a top plan view of two semirigid supports for use with the present nursing cover.
Figure 7:
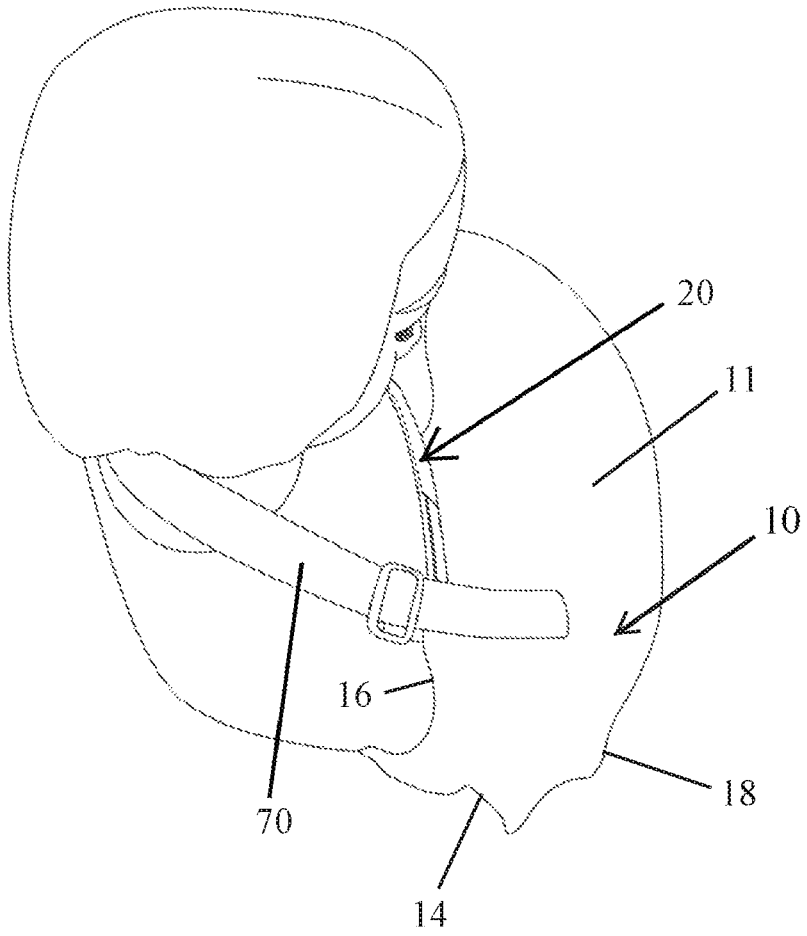
FIG. 7 is a top perspective view of the present nursing cover when in use, with the semirigid support detached from the fixation points of the nursing cover.
Figure 8:
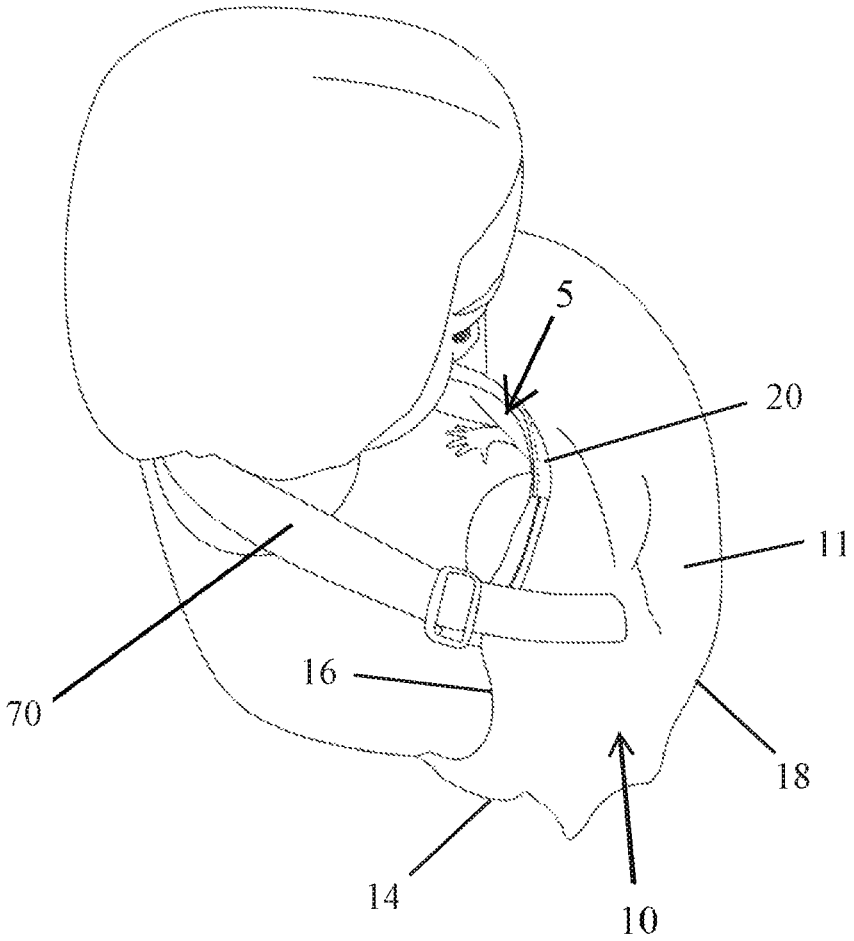
FIG. 8 is a top perspective view of the present nursing cover when in use, with the semirigid support attached to the fixation points of the nursing cover.

The sleeve 20 is adapted to be used together with a semirigid support 40, which is configured to fit through the interior channel of the sleeve. The semirigid support 40 is an elongated structure that generally comprises a proximal end 42, a distal end 48, a medial portion 49, and at least two fastener portions 45. The fastener portions 45 are positioned in a spaced-apart manner with a medial extent therebetween, and preferably are positioned on each longitudinal end of the semirigid support 40. As shown in FIG. 6C, a semirigid support 40 can comprise only proximal fastener portion 41 and distal fastener portion 43, or can include additional fastener portions such as inner proximal fastener portion 44 and inner distal fastener portion 46, The semirigid support 40 can be made from plastic, metal, hard rubber, carbon fiber or any other material that's rigid enough to hold its shape but flexible enough to bend under the stress of being bent in the context of the present nursing cover, preferably without exceeding its elastic limit. The semirigid support 40 is used to create an opening 5 at the upper end of the panel 10, as shown in FIG. 8. This is accomplished by placing the semirigid support 40 through the interior channel of the sleeve 20 such that proximal fastener portion 41 and distal fastener portion 43 of the semirigid support 40 both extend outside the channel of the sleeve 20, as shown for example in FIG. 2. The proximal fastener portion 41 and distal fastener portion 43 are then reversibly secured to fixation points 30 attached to the panel 10, by attaching proximal fastener portion 41 to a right side fixation point 31 and distal fastener portion 43 to a left side fixation point 33, which are adjacent to the right side opening 27 and left side opening 29 of the sleeve 20, respectively. When the distance between the right side fixation point 31 and the left side fixation point 33 is less than the distance between the proximal fastener portion 41 and the distal fastener portion 43 of the semirigid support 40, the semirigid support 40 will bend or bow outwardly, as shown in FIGS. 4 and 5, and the upper side 16 of the panel 10 will consequently extend outwardly with respect to a caregiver, generally in an arcuate fashion. In this way, the sleeve 20, fixation points 30, and semirigid support 40 cooperate to form a rigid or semirigid collar portion in the flexible material of the panel 10 and thereby create an opening 5 for the caregiver to view and/or access a baby supported underneath the nursing cover 1 when the nursing cover is worn by the caregiver when this is desired. Preferably, the sleeve 20 is positioned in a center portion of the upper side 16 of the panel 10, so that when the semirigid support 40 is secured to the fixation points 30 and placed under tension, the tension of the semirigid support 40 causes the semirigid support 40 to bow outwardly in the center of the nursing cover 1.

The fixation points 30 are attached to the panel 10 outside the openings of the sleeve 20, so that each fixation point is spaced apart laterally from an opening, either further to the right of an opening or further to the left. The right side fixation point 31 is attached to the panel 10 adjacent to the right side opening 22 of the sleeve 20 and the left side fixation point 31 is attached to the panel adjacent to the left side opening 24 of the sleeve, as shown in FIG. 6A, for example. The fixation points 30 and the fastener portions 45 of the semirigid support 40 can comprise any of a number of reversibly securable fastening components known to the art. For example, the fixation points 30 and fastener portions 45 can be formed from matching snaps, molded plugs, buttons, slaps, hook and loop material, or other mechanisms for reversibly securing the ends of the semirigid support 40 to the panel 10. In the illustrated embodiments, the fixation points 30 comprise a boss, stud, rivet, or button having an extending post or projection, which may have a projecting edge, rim, or flange at a distal end for a more secure fit. The projections of the fixation points 30 are sized to retain the receptacles or receiving portions of the fastener portions 45 of the semirigid support 40 with an interference fit or friction fit. In another embodiment, the fixation points 30 and the fastener portions 45 can be configured in the manner of a snap fastener (also called a press stud or snap), comprising a pair of interlocking discs made out of a metal or plastic, in which a circular lip under one disc fits into a groove on the top of the other, holding them fast until a force is applied.

The shape and size of the opening 5 in the collar 35 can be adjusted by fixing the semirigid support 40 on different fixation points 30 on the nursing cover collar. As best seen in FIGS. 4 and 5, for example, if fastener portion 41 is secured to fixation point 31 and fastener portion 43 is secured to fixation point 33, then the collar 35 will have a first configuration (shown in FIG. 4). If fastener portion 41 is secured to fixation point 34 and fastener portion 43 is secured to fixation point 36, however, then the collar 35 will have a second configuration (shown in FIG. 5) in which the collar 35 extends further outwardly and has a different degree of bowing radius. In some embodiments, the semirigid support 40 can comprise two (or more) fastener portions 45. In addition to providing flexibility in configuring the shape of the collar 35, the multiple fastener portions 45 on each end of the semirigid support 40 can engage fixation points simultaneously, in order to more securely affix the semirigid support 40 to panel 10. For example, fastener portions 41 and 44 can be secured to fixation points 31 and 34, respectively, and fastener portions 43 and 46 can be secured to fixation points 33 and 36, respectively.

The semirigid support 40 can be released by detaching at least one of the two longitudinal ends of the semirigid support from its respective fixation point 30. Releasing the semirigid support 40 closes the opening 5, thereby providing more privacy for a user during breastfeeding.

Storage Pouch

Figure 9:
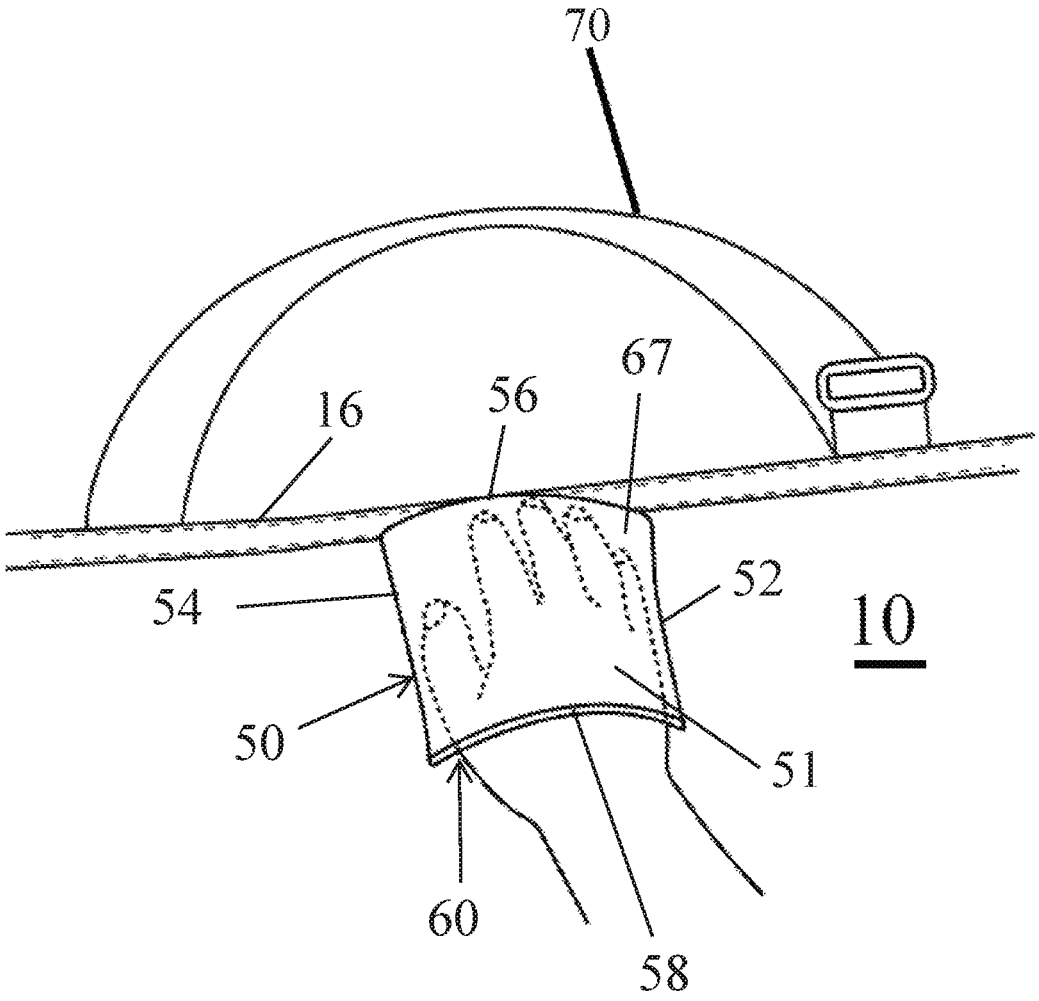
FIGS. 9-12 illustrate the sequential steps used to store the present nursing cover in an attached pouch.
Figure 10:
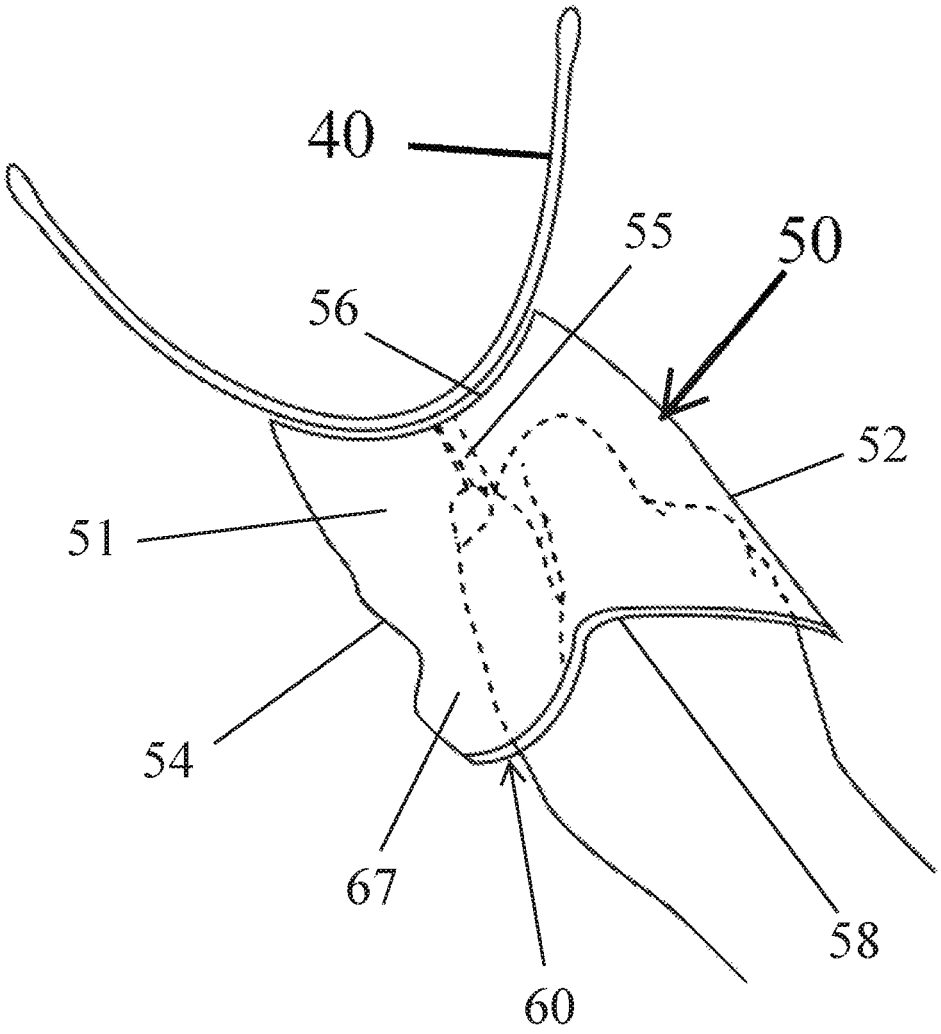

In some embodiments, the present nursing cover 1 can include a built-in storage pouch 50. In a preferred embodiment, the storage pouch 50 generally comprises a front panel 51, a back panel 53, an upper side 56, a lower side 58, a right side 52, a left side 54, a pull tab 55, a front panel inner face 57, a back panel inner face 59, a front panel outer face 67, and a back panel outer face (not shown). An opening 60 is formed in the lower side 58 and the opposing upper side 56 is closed and attached to the collar 35 of the nursing cover 1. A pull tab 55 is preferably provided in the closed end 56, inside the pouch in its initial unused configuration (as shown in FIGS. 9 and 10), i.e. in the bottom of the inside of the storage pouch 50 before it's reversed. The pull tab 55 is preferably made from a flexible material such as fabric, but can also be die cut or molded from a soft or hard plastic material.

Figure 11:
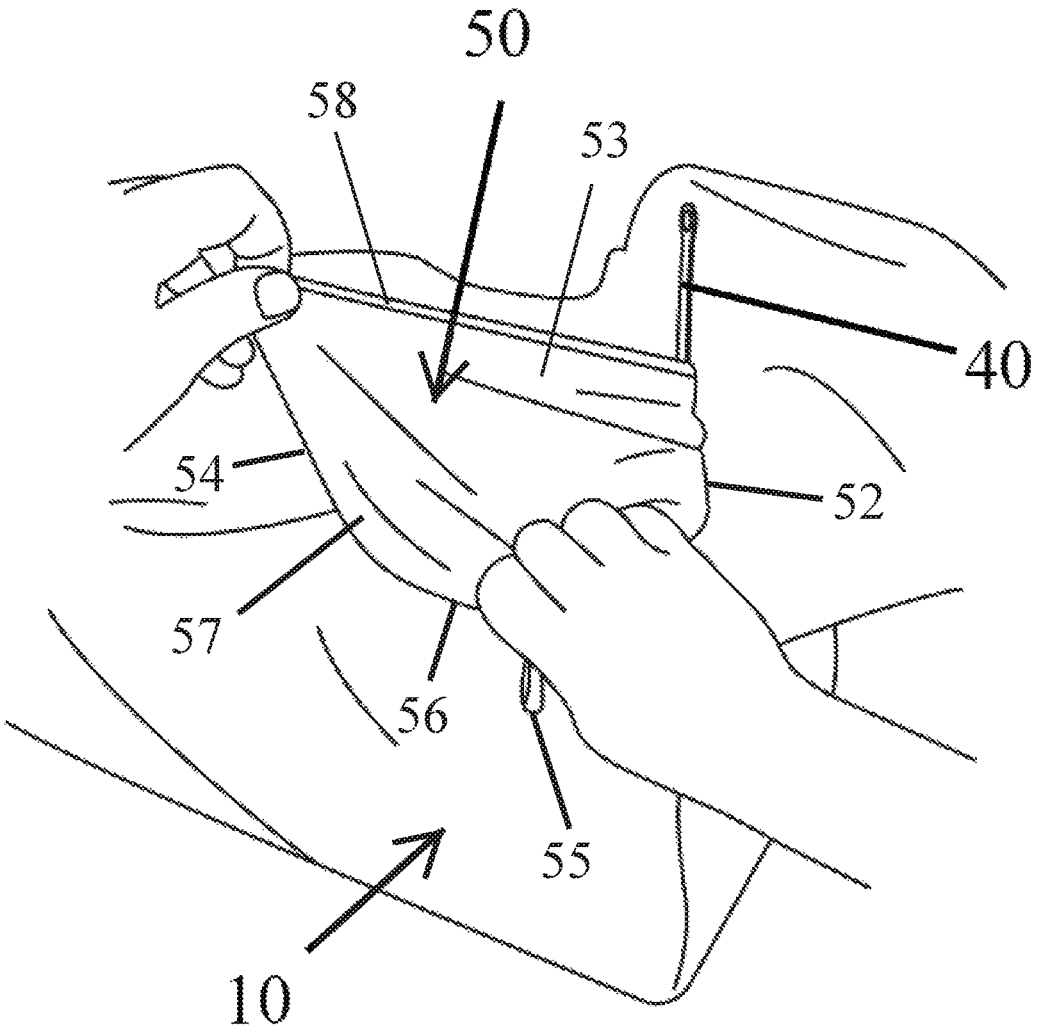
Figure 12:
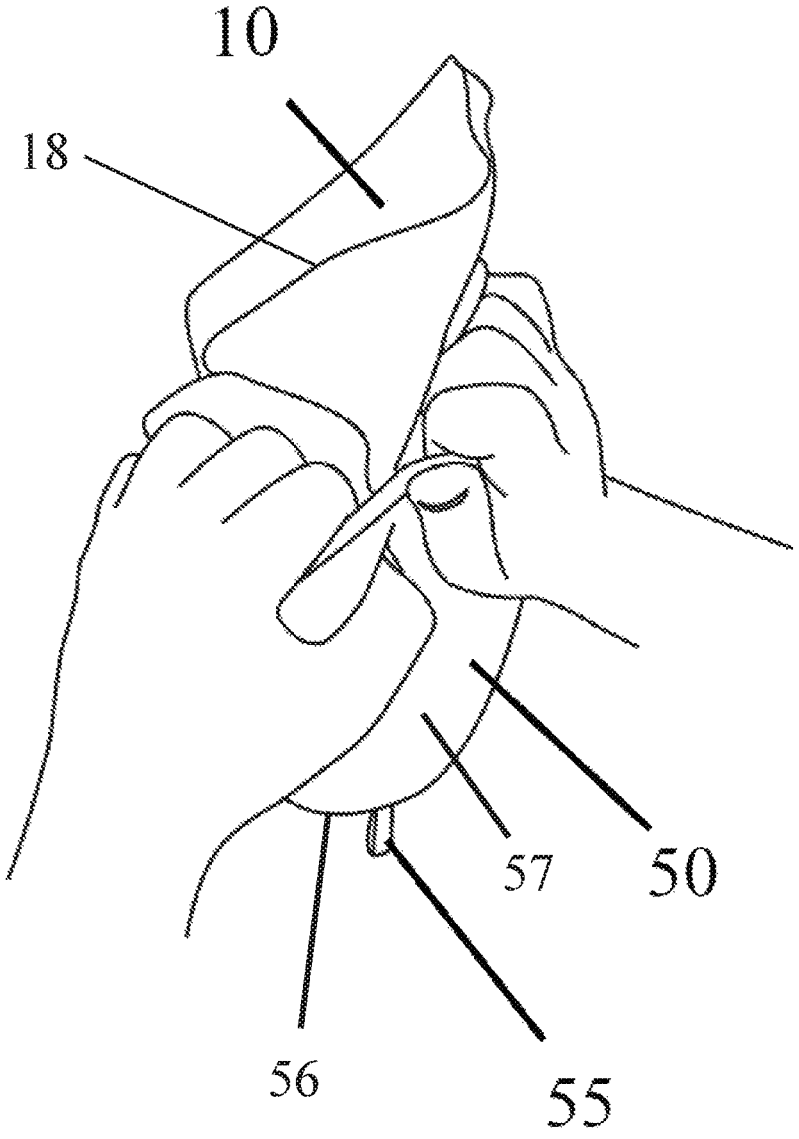
Figure 13:
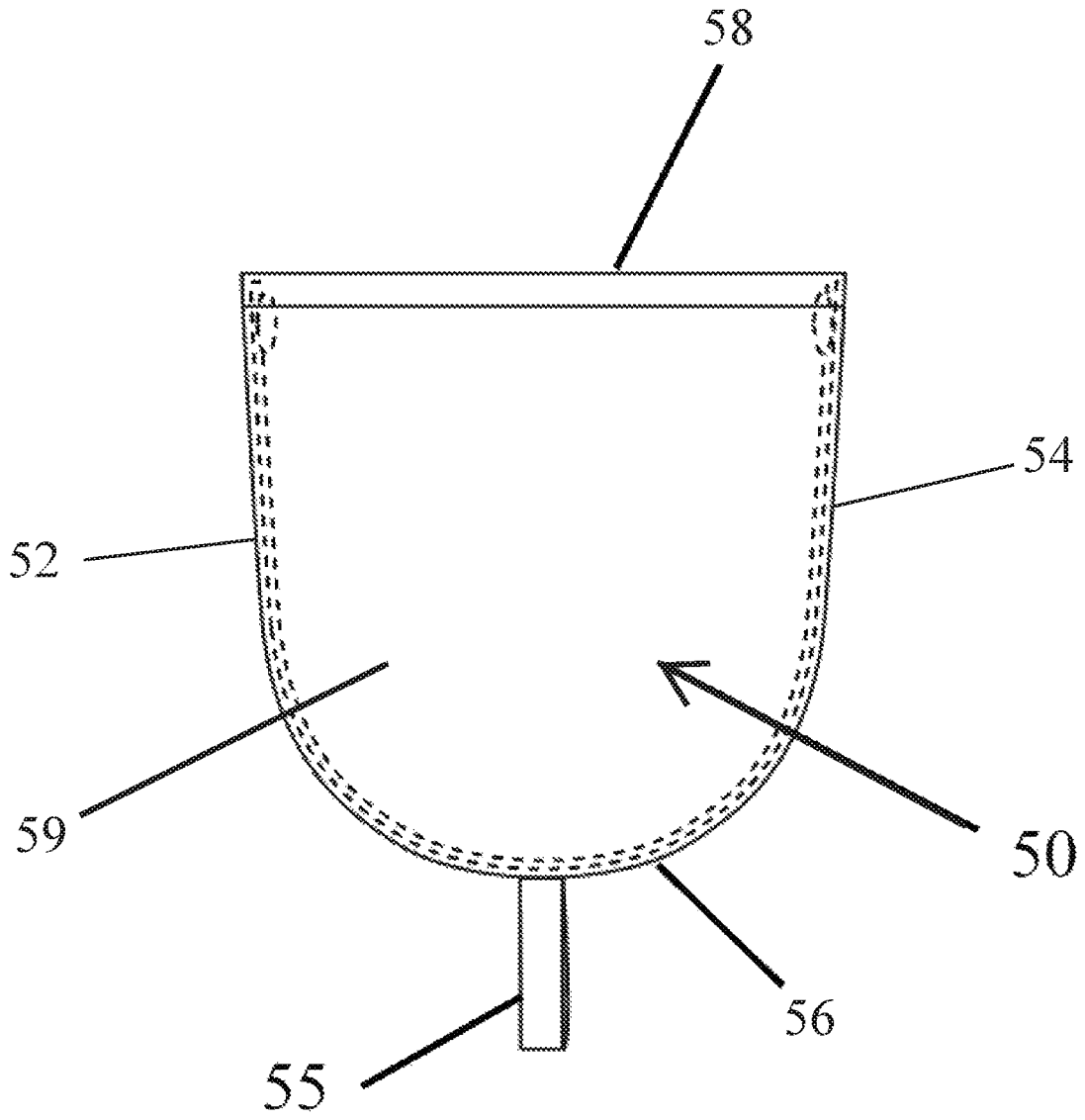
FIG. 13 is a front elevation view of the pouch of the present nursing cover.

To reverse the storage pocket 50 and store the panel 10 inside it, the storage pouch is placed in an inside-out configuration, so that the front side inner face 57 and rear side inner face 59 face the outside, as shown in FIGS. 11-13. The panel 10 is then pushed or folded into the interior of the storage pouch in its secondary configuration (i.e., inside out), as shown in FIG. 12.

In a preferred embodiment, the upper side 56 of the storage pouch 50 is attached to the panel 10 near the upper side 16, and preferably is attached near and/or below the sleeve 20, either on the same side of the panel as the sleeve 20 (usually front side 11) or on the opposing side of the panel 10 (such as on back side 13). In this configuration, when the semirigid support 40 is contained in the sleeve 20 (and preferably released from fixation points 30), pulling the pull tab 55 will simultaneously pull the semirigid support 40 in the sleeve 20 into the pocket 50. Because pulling force is only applied to the center of the semirigid support 40, the semirigid support enters into the reversed storage pouch 50 with relatively little resistance. The opening 60 of the pouch 50 preferably has a width which is less than the length of the semirigid support 40 so that the semirigid support 40 is bent as it enters the opening 60, so that the semirigid support 40 thereby exerts tension against the interior of the pouch 50 in its inside-out configuration and helps to maintain the interior space of the pouch 50 in this configuration. The support of the storage pouch 50 concurrently protects the semirigid support 40 from being bent in a manner that might potentially deform the semirigid support, in particular when it is made of a plastic material, as soft plastic rods often have shape memories. In this configuration, the semirigid support 40 is located in and secured to the bottom side of the pouch 50, so that the semirigid support lays inside the pouch and is naturally bent.

Although the present invention has been described in considerable detail with reference to certain preferred embodiments, other embodiments are possible. The steps disclosed for the present methods, for example, are not intended to be limiting nor are they intended to indicate that each step is necessarily essential to the method, but instead are exemplary steps only. Therefore, the scope of the appended claims should not be limited to the description of preferred embodiments contained in this disclosure.

As used herein, the following terms and variations thereof have the meanings given below, unless a different meaning is clearly intended by the context in which such term is used. The term "comprise" and variations of the term, such as "comprising" and "comprises," are not intended to exclude other additives, components, integers or steps. The terms "a," "an," and "the" and similar referents used herein are to be construed to cover both the singular and the plural unless their usage in context indicates otherwise. Ranges which are described as being "between" two values include the indicated values. Recitation of value ranges herein is merely intended to serve as a shorthand method for referring individually to each separate value falling within the range. Unless otherwise indicated herein, each individual value is incorporated into the specification as if it were individually recited herein. All references cited herein are incorporated by reference in their entirety.

What is claimed is:

1. A nursing cover, comprising:

a panel having a front side, a back side, an upper side, and a lower side;

a sleeve provided in the panel adjacent to the upper side of the panel, the sleeve having an upper side, a lower side, a right side having a right side opening, a left side having a left side opening, and a medial portion between the right side and the left side, wherein the sleeve comprises a hollow interior between the right side opening and the left side opening;

a right side fixation point and a left side fixation point, wherein the right side fixation point is attached to the panel adjacent to the right side opening of the sleeve and the left side fixation point is attached to the panel adjacent to the left side opening of the sleeve;

a semirigid support having a right side, a left side, and a longitudinal extent between the right side and the left side, further comprising an outer right side fastener portion, an inner right side fastener portion located medially with respect to the outer right side fastener portion, an outer left side fastener portion, and an inner left side fastener portion located medially with respect to the outer left side fastener portion, wherein the right side fastener portions are configured to be reversibly secured to the right side fixation point and the left side fastener portions are configured to be reversibly secured to the left side fixation point, wherein the distance between the inner right side fastener portion and the inner left side fastener portion is less than the distance between the outer right side fastener portion and the outer left side fastener portion, so that when the outer right side fastener portion is attached to the right side fixation point and the outer left side fastener portion is attached to the left side fixation point, the upper side of the panel extends further outwardly than when the inner right side fastener portion is attached to the right side fixation point and the inner left side fastener portion is attached to the left side fixation point; and a neck strap having a proximal end and a distal end, wherein the proximal end and the distal end of the neck strap are attached or reversibly securable to the upper side of the panel, wherein the distance between the right side fixation point and the left side fixation point is less than the distance between the inner or outer right side fastener portion and the inner or outer left side fastener portion of the semirigid support, so that when the semirigid support is placed through the sleeve, and the inner or outer right side fastener portion is attached to the right side fixation point and the inner or outer left side fastener portion is attached to the left side fixation point, then the upper side of the panel extends outwardly with respect to a caregiver in a collar portion formed by the sleeve and the semirigid support, thereby forming an opening when the nursing cover is worn by the caregiver.

2. The nursing cover of claim 1, further comprising a storage pouch having an upper side and a lower side, the storage pouch comprising an open upper end and closed lower end, wherein a portion of the upper side of the pouch is attached to the upper side of the panel.

3. The nursing cover of claim 2, wherein the storage pouch further comprises a pull tab extending from the lower side of the storage pouch.

4. The nursing cover of claim 2, wherein the pouch is attached to the panel adjacent to the sleeve.

5. The nursing cover of claim 1, further comprising an outer right side fixation point and an outer left side fixation point, wherein the outer right side fixation point is attached to the panel further from the right side opening of the sleeve than the inner right side fixation point, and wherein the outer left side fixation point is attached to the panel further from the left side opening of the sleeve than the inner left side fixation point.

6. The nursing cover of claim 5, wherein the semirigid support further comprises an inner proximal fastener portion located distally with respect to the proximal fastener portion and an inner distal fastener portion located proximally with respect to the distal fastener portion, wherein the inner proximal fastener portion is reversibly securable to the inner right side fixation point and the inner distal fastener portion is reversibly securable to the inner left side fixation point.

7. The nursing cover of claim 1, wherein the proximal end of the neck strap is attached or reversibly securable to the right of the right side of the sleeve and the distal end of the neck strap is attached or reversibly securable to the left of the left side of the sleeve.

8. The nursing cover of claim 1, wherein the neck strap comprises a first portion and a second portion, wherein a proximal end of the first portion of the neck strap is attached to the upper side of the panel to the right of the right side of the sleeve, and wherein a proximal end of the second portion of the neck strap is attached to the upper side of the panel to the left of the left side of the sleeve.

9. The nursing cover of claim 8, wherein a fastener is attached to the distal end of the first portion or the second portion of the neck strap.

10. The nursing cover of claim 9, wherein the fastener is a buckle attached to the second portion of the neck strap, and wherein the distal end of the first portion of the neck strap comprises holes for retaining the buckle.

11. The nursing cover of claim 9, wherein the fastener is a release buckle.

12. The nursing cover of claim 1, wherein the panel further comprises a right side and a left side.

13. The nursing cover of claim 12, wherein the sleeve is in a central portion of the upper side of the panel.

14. The nursing cover of claim 12, wherein the panel is a quadrilateral.

15. A nursing cover, comprising:

a panel having a front side, a back side, an upper side, and a lower side;

a sleeve provided in the panel adjacent to the upper side of the panel, the sleeve having an upper side, a lower side, a right side having a right side opening, a left side having a left side opening, and a medial portion between the right side and the left side, wherein the sleeve comprises a hollow interior between the right side opening and the left side opening;

an inner right side fixation point, an inner left side fixation point, an outer right side fixation point, and an outer left side fixation point, wherein the inner right side fixation point and outer right side fixation point can be attached to the panel adjacent to the right side opening of the sleeve and the inner left side fixation point and outer left side fixation point can be attached to the panel adjacent to the left side opening of the sleeve, wherein the outer right side fixation point is attached to the panel further from the right side opening of the sleeve than the inner right side fixation point, and wherein the outer left side fixation point is attached to the panel further from the left side opening of the sleeve than the inner left side fixation point;

a semirigid support having right side, a left side, and a longitudinal extent between the right side and the left side, further comprising an outer right side fastener portion and an outer left side fastener portion, wherein the outer right side fastener portion is configured to be reversibly secured to the inner or outer right side fixation point and the outer left side fastener portion is configured to be reversibly secured to the inner or outer left side fixation point; and a neck strap having a proximal end and a distal end, wherein the proximal end and the distal end of the neck strap are attached or reversibly securable to the upper side of the panel, wherein the distance between the inner or outer right side fixation point and the inner or outer left side fixation point is less than the distance between the outer right side fastener portion and the outer left side fastener portion of the semirigid support, so that when the semirigid support is placed through the sleeve, the outer right side fastener portion is attached to the inner or outer right side fixation point, and the outer left side fastener portion is attached to the inner or outer left side fixation point, then the upper side of the panel extends outwardly with respect to a caregiver in a collar portion formed by the sleeve and the semirigid support, thereby forming an opening when the nursing cover is worn by the caregiver.

16. The nursing cover of claim 15, wherein the semirigid support further comprises an inner right side fastener portion located medially with respect to the outer right side fastener portion and an inner left side fastener portion located medially with respect to the distal left side fastener portion, wherein the inner right side fastener portion is reversibly securable to the inner right side fixation point and the inner left side fastener portion is reversibly securable to the inner left side fixation point.

17. The nursing cover of claim 15, further comprising a storage pouch attached to the panel adjacent to the sleeve, the storage pouch having an upper side and a lower side and comprising an open upper end and closed lower end, wherein a portion of the upper side of the pouch is attached to the upper side of the panel.

18. The nursing cover of claim 15, wherein the proximal end of the neck strap is attached or reversibly securable to the right of the right side of the sleeve and the distal end of the neck strap is attached or reversibly securable to the left of the left side of the sleeve.

19. The nursing cover of claim 15, wherein the neck strap comprises a first portion and a second portion, wherein a proximal end of the first portion of the neck strap is attached to the upper side of the panel to the right of the right side of the sleeve, and wherein a proximal end of the second portion of the neck strap is attached to the upper side of the panel to the left of the left side of the sleeve.

20. The nursing cover of claim 19, wherein a fastener is attached to the distal end of the first portion or the second portion of the neck strap.

* * * * *